US007185776B1

(12) United States Patent
Konefal

(10) Patent No.: US 7,185,776 B1
(45) Date of Patent: Mar. 6, 2007

(54) CLOSURE AND CONTAINER PACKAGE

(75) Inventor: Robert S Konefal, Wilton, NH (US)

(73) Assignee: Owens-Illinois Prescription Products Inc., Perrysburg, OH (US)

( * ) Notice: Subject to any disclaimer, the term of this patent is extended or adjusted under 35 U.S.C. 154(b) by 204 days.

(21) Appl. No.: 10/778,508

(22) Filed: Feb. 16, 2004

(51) Int. Cl.
*B65D 39/00* (2006.01)

(52) U.S. Cl. ..... 215/228; 215/330

(58) Field of Classification Search ..... 215/228, 215/222, 221, 330–332
See application file for complete search history.

(56) References Cited

U.S. PATENT DOCUMENTS

| | | | | |
|---|---|---|---|---|
| RE27,156 | E | 7/1971 | Hedgewick | |
| 3,667,637 | A | 6/1972 | Landen | |
| 3,809,276 | A | 5/1974 | Landen | |
| 3,880,313 | A | 4/1975 | Akers | |
| 3,896,959 | A * | 7/1975 | Roy | 215/222 |
| 3,951,289 | A | 4/1976 | Landen | |
| 4,049,148 | A | 9/1977 | Suhr et al. | |
| 4,053,078 | A | 10/1977 | Herr | |
| 4,057,159 | A | 11/1977 | Fillmore et al. | |
| 4,059,198 | A | 11/1977 | Mumford | |
| 4,346,809 | A | 8/1982 | Kusz | |
| 4,383,619 | A | 5/1983 | Mumford et al. | |
| 4,399,920 | A | 8/1983 | Swartzbaugh et al. | |
| 4,485,932 | A * | 12/1984 | Kusz | 215/222 |
| 4,526,281 | A | 7/1985 | Herr | |
| 4,567,992 | A * | 2/1986 | Davis | 215/222 |
| 4,579,238 | A | 4/1986 | Herr | |
| 4,627,547 | A | 12/1986 | Cooke | |
| 4,739,890 | A | 4/1988 | Cooke | |
| 4,753,189 | A * | 6/1988 | Mastman et al. | 116/308 |
| 5,213,223 | A | 5/1993 | Minnette | |

(Continued)

FOREIGN PATENT DOCUMENTS

| | | |
|---|---|---|
| GB | 2 155 985 A | 10/1985 |
| WO | WO 95/04679 | 2/1995 |

OTHER PUBLICATIONS

Dutch Application—Effective date unknown.
U.S. Appl. No. 10/684,724, filed Oct. 13, 2003.

*Primary Examiner*—Lien M. Ngo

(57) ABSTRACT

A package includes a closure that is applied to a container. The closure includes a base wall having a cylindrical skirt depending therefrom. Locking lugs and cam lugs extend in a radially inward direction from the skirt. As the closure is applied down on the container, the locking lugs engage notches formed in the undersides of the projections and internal cam surfaces on the cam lugs engage external cam surfaces formed on projections disposed around the open end of the container. As a downward force is applied to the closure onto the container, the internal cam surface travels axially downwardly over the external cam surface, thereby causing the cylindrical skirt to spread radially outwardly. As the application force is released, a reaction force, due to the inherent resiliency of the cylindrical skirt, causes the cylindrical skirt to contract and permit the internal cam surface to be urged axially upwardly along with the rest of the closure including the locking lugs, which become urged into further easement with the notches of the container. The closure is adapted to be inverted and secured to the container in a non-child-resistant mode of operation.

5 Claims, 6 Drawing Sheets

U.S. PATENT DOCUMENTS 5,449,078 A 9/1995 Akers
5,927,528 A 7/1999 Jones
5,927,532 A 7/1999 Traub
5,934,492 A 8/1999 Jones
5,938,055 A 8/1999 Philips et al.
6,161,711 A 12/2000 Miceli et al.
6,378,713 B2 4/2002 Montgomery
6,446,823 B2 9/2002 Miceli et al.
6,523,709 B2 2/2003 Miceli et al.
2001/0019033 A1 9/2001 Montgomery
2001/0035388 A1 11/2001 Miceli et al.
2002/0195412 A1 12/2002 Miceli et al.
2003/0075519 A1 4/2003 Miceli et al.
2004/0173562 A1* 9/2004 Wolfe ..... 215/222

* cited by examiner

CLOSURE AND CONTAINER PACKAGE

The present invention relates to child-resistant closure and container packages, such as prescription packages for example, to closures and containers for such packages, and to methods of making such packages.

BACKGROUND AND SUMMARY OF THE INVENTION

U.S. Pat. Nos. 4,057,159, 4,059,198 and 4,485,932 disclose child-resistant closure and container prescription packages that include a container or vial, a closure, and a spring/seal disk arrangement disposed between the closure and the container. The closure has lugs on an inside surface of a skirt that cooperate with external locking notches or pockets on projections around the mouth of the container for securing the closure to the container. An internal abutment on the closure cooperates with the spring/seal disk(s) to urge the closure away from the container so that the lugs are resiliently captured within the notches. When it is desired to remove the closure, the closure is pushed toward the container so that the lugs clear the notches, and then turned counterclockwise. When the closure is assembled to the container, the lugs cam beneath surfaces on the projections against the force of the spring seal disk(s) until the lugs snap into the notches on the projections.

Although the closure and container packages disclosed in the noted patents have enjoyed substantial commercial acceptance and success, improvements remain desirable. For example, it is desirable to minimize the complexity of the design and manufacture of closure and container packages by reducing the quantity of parts thereof. Accordingly, it is a general object of the present invention is to provide a two-piece package of the subject type—i.e., a closure and a container without a separate spring element or self-resilient spring-like members—in which the spring forces for holding the closure on the container are provided by resilient flexure of the closure. It is a related object to provide a simple closure and container package that does not require delicate spring-like members. Accordingly, it is possible to produce more robust mold tools that do not have correspondingly delicate mold features, wherein the mold tools have a longer service life.

The present invention embodies a number of aspects that can be implemented separately from or, more preferably, in combination with each other.

A package in accordance with one aspect of the invention includes a container having an open end surrounded by a cylindrical wall, a plurality of external projections on the wall, notches on undersides of the projections, and external cam surfaces on the projections that incline radially inwardly and axially toward the open end. A closure has a base wall with a skirt, a plurality of internal locking lugs on the skirt, and a plurality of internal cam lugs on the skirt that are disposed between the locking lugs and the base wall. As the closure is applied over the end of the container and the locking lugs are received in the notches, the internal cam lugs engage the external cam surfaces on the projections to spread the skirt and bias the locking lugs into the notches. A two-piece package in accordance with the present invention thus eliminates any need for additional spring/seal disk elements in the assembly.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
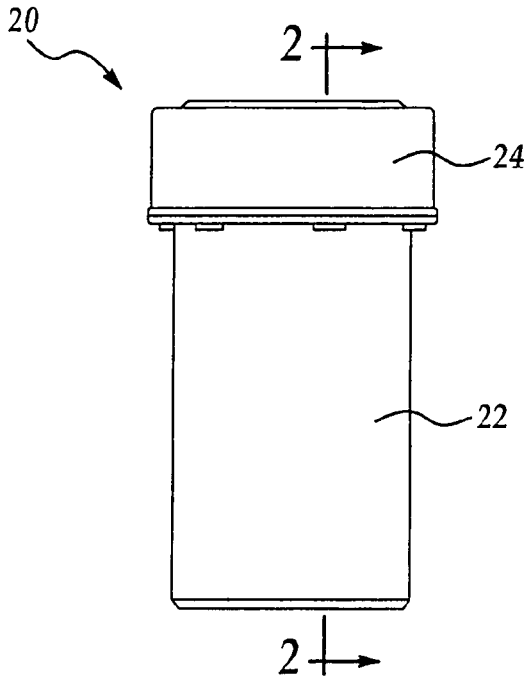
FIG. 1 is an elevational view of a closure and container package, wherein a closure is assembled to a container in child-resistant mode according to an exemplary embodiment of the present invention.
Figure 4:
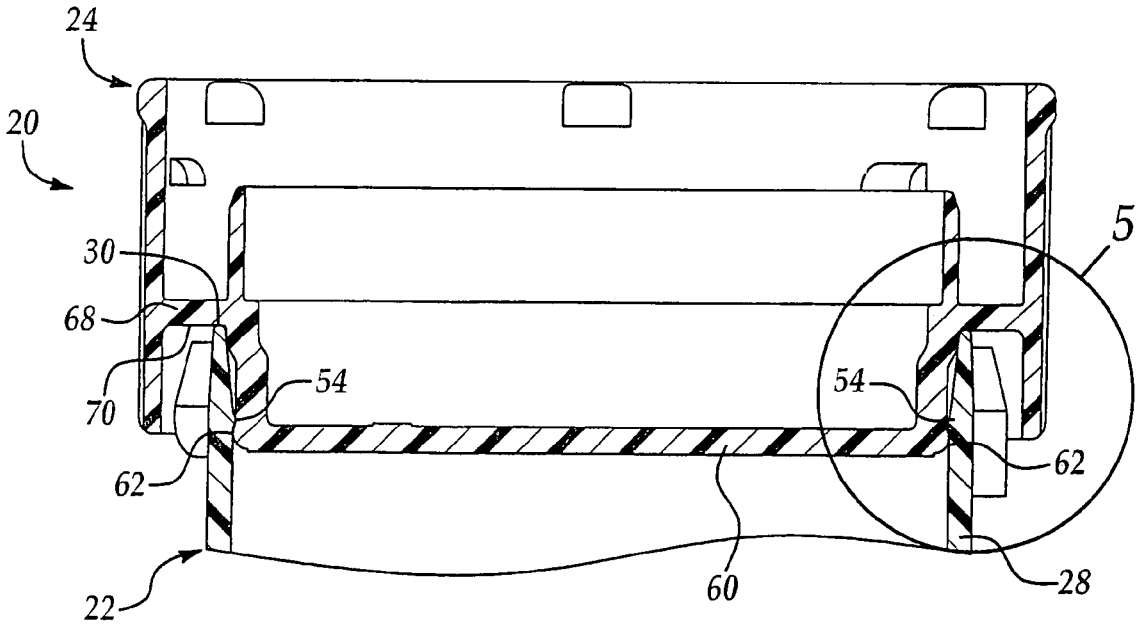
FIG. 4 is a fragmentary sectional view of the package illustrated in FIG. 1, wherein the closure is inverted and assembled to the container in a non-child-resistant mode.
Figure 5:
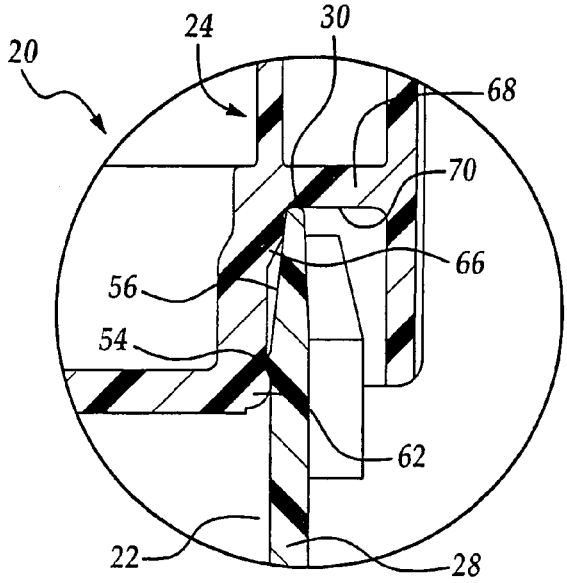
FIG. 5 is a fragmentary sectional view of the package illustrated in FIG. 4 within circle 5 and on an enlarged scale.
Figure 6:
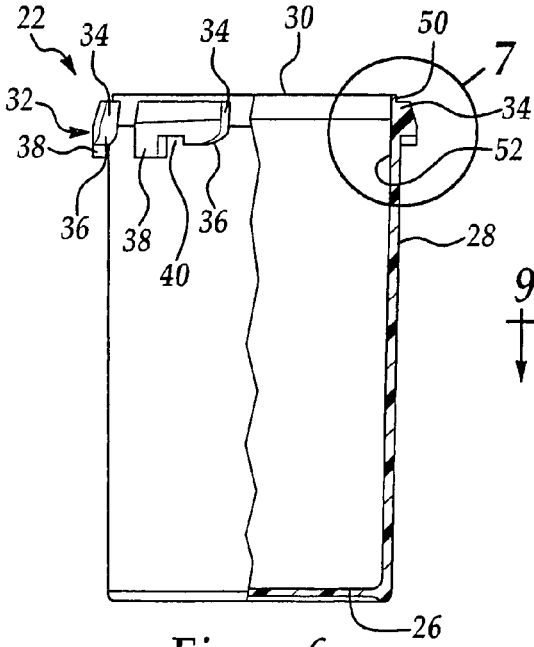
FIG. 6 is a partially sectioned elevational view of the container of FIG. 1.

FIG. 1 illustrates a package 20 in accordance with a presently preferred embodiment of the invention. The package 20 includes a vial or container 22 and a closure 24 secured to the container 22 either in a child-resistant mode of operation as shown in FIGS. 1–3 and FIG. 14, or in a non-child-resistant mode of operation as shown in FIGS. 4–5.

Referring generally to FIGS. 6–9, the container 22 includes a bottom wall 26 and a side wall 28 extending upwardly therefrom and terminating in an open mouth or end 30. The side wall 28 includes a finish portion 32 that surrounds the open end 30 and that includes a circumferential array of projections 34 extending radially outwardly therefrom. The projections 34 may be bayonet-like in shape, but may be any type of surface manifestations that are adapted for retaining the closure 24 (shown in FIGS. 1–3 and 10–13) to the container 22. Each projection 34 includes an underside cam portion 36, a stop lug portion 38, and a flat underside 42 that cooperate to define an undersurface of the projection having a notch 40 therein. The projections 34 lie in a plane that is generally perpendicular to the longitudinal axis of the container 22 wherein the plane is defined by top surfaces 44 of the projections 34. Radially outwardly of the top surfaces 44, the projections 34 include angulated or external cam surfaces 46 that taper or incline radially inwardly in a direction axially toward the open end 30 of the container 22. As shown, the external cam surfaces 46 are on a common cone of revolution and terminate at a radially outer edge 48 of the projections 34. In other words, the entire radially outer profile of the projections 34 could be provided with the external cam surface 46. In any case, a generally cylindrical stem portion 50 of the side wall 28 of the container 22 extends upwardly from the top surfaces 44 of the projections 34.

Figure 7:
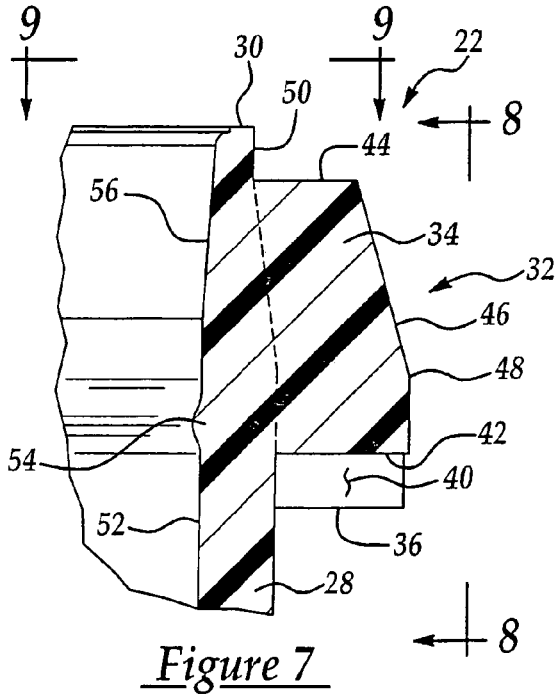
FIG. 7 is a fragmentary sectional view of the container of FIG. 6 within circle 7 and on an enlarged scale.
Figure 8:
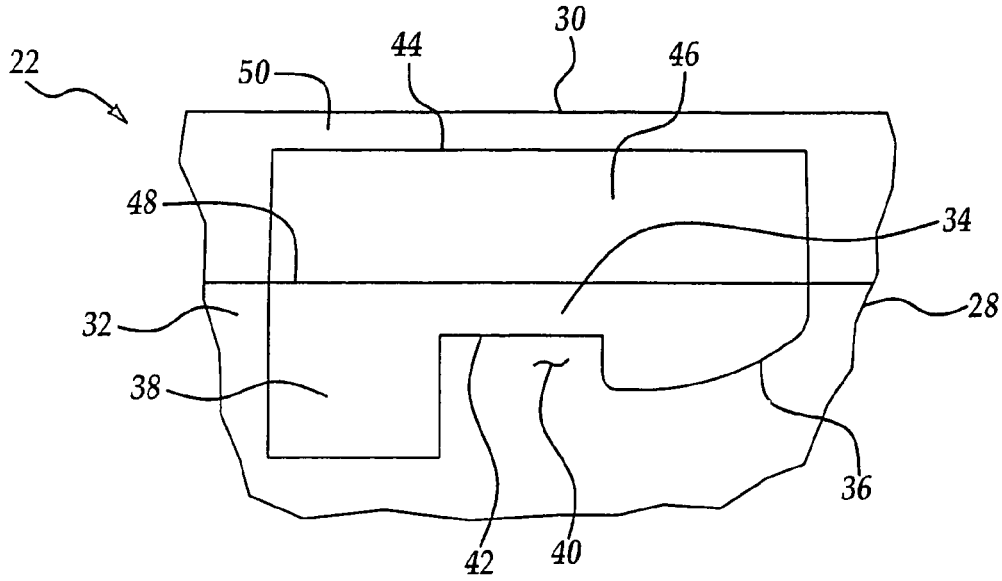
FIG. 8 is an enlarged fragmentary view of the container of FIG. 7 taken along lines 8—8 thereof.
Figure 9:
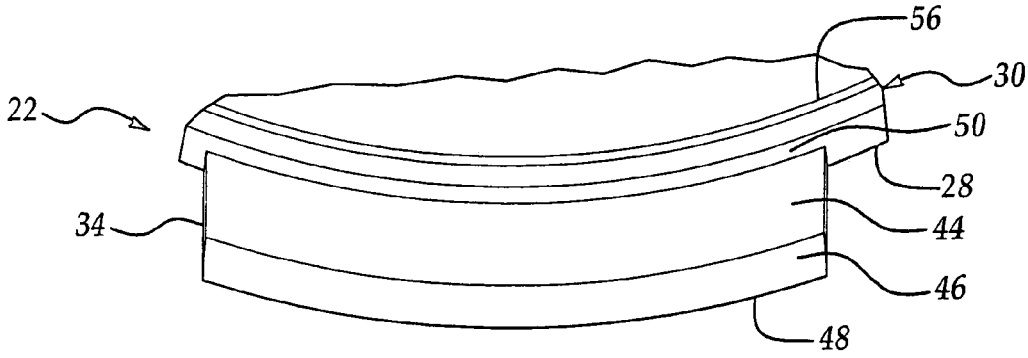
FIG. 9 is an enlarged fragmentary view of the container of FIG. 7 taken along lines 9—9 thereof.
Figure 10:
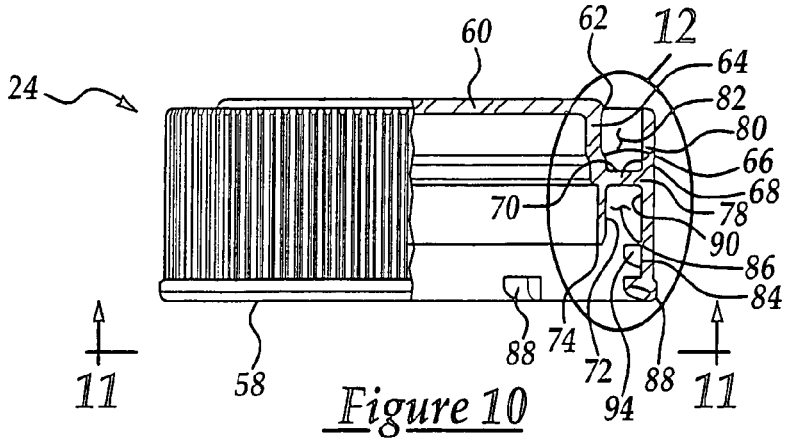
FIG. 10 is a partially sectioned elevational view of the closure of FIG. 1.
Figure 11:
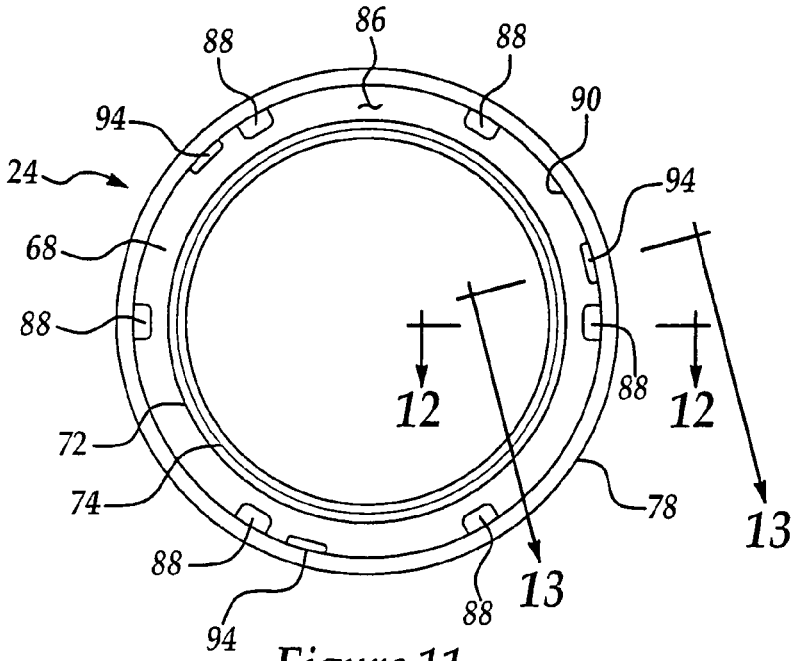
FIG. 11 is a plan view of the underside of the closure of FIG. 10 taken along lines 11—11.
Figure 12:
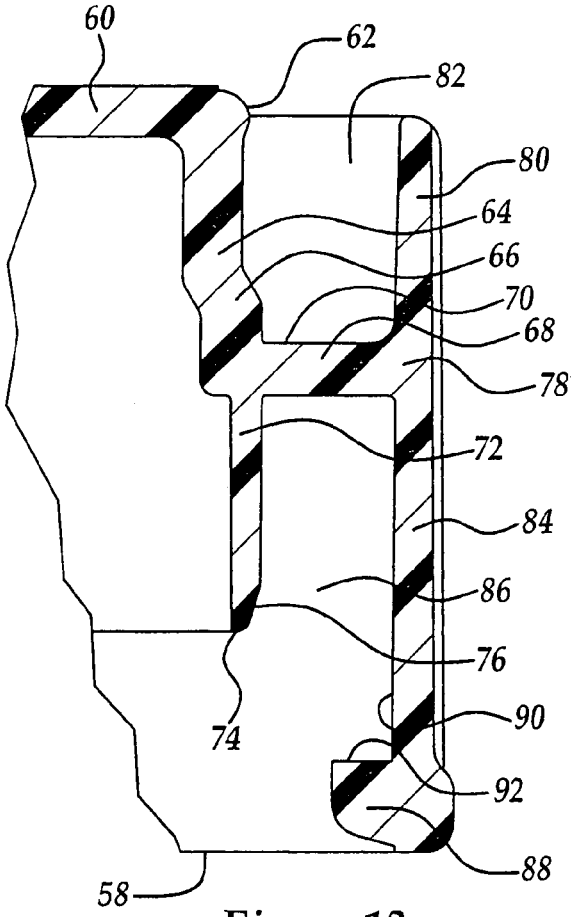
FIG. 12 is a fragmentary sectional view of the closure of FIG. 11 taken along lines 12—12 and on an enlarged scale.
Figure 13:
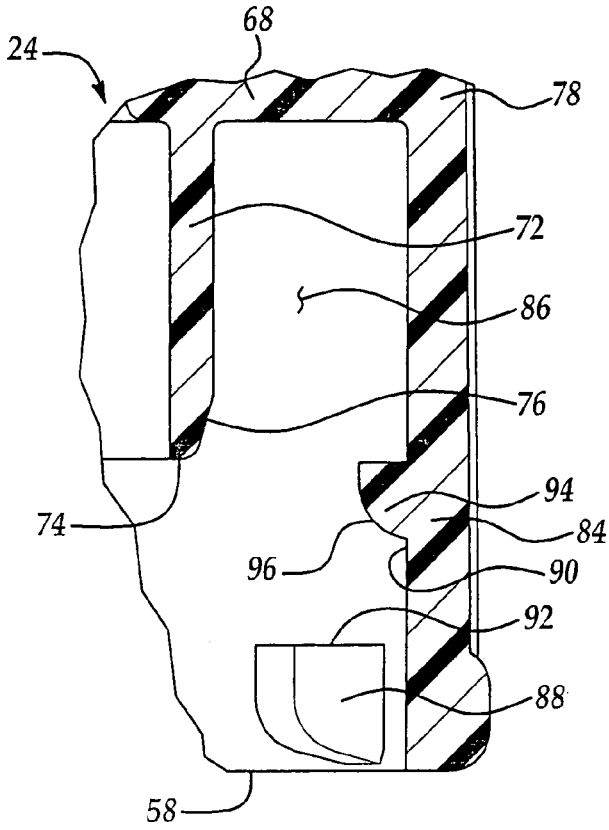
FIG. 13 is a fragmentary sectional view of the closure of FIG. 11 taken along lines 13—13 and on an enlarged scale.

As best shown in FIG. 7, the container includes an internal cylindrical surface 52 extending upwardly toward the upper end 30 and includes a circumferential bead 54 extending radially inwardly from the side wall 28 of the container 22. The bead 54 may be circumferentially segmented or interrupted but is preferably continuous. Between the bead 54 and the open end 30, there is disposed a tapered internal surface 56 that functions as a sealing surface for sealing the closure 24 to the container 22 against moisture intrusion. The tapered internal surface 56 is tapered with respect to the longitudinal axis of the container 22 at an angle between 0 and 90 degrees, but is preferably 2.5 degrees.

Referring now to FIGS. 10–13, the closure 24 includes an open end 58 and a wall 60 opposite of the open end 58 that terminates in a radially outward direction in the form of an annular projection 62 that is adapted to engage the bead 54 of the container 22 (shown in FIGS. 1–3 and 6–9) in a non-child-resistant mode of operation. An internal skirt or wall 64 extends axially away from the wall 60, includes a stepped portion 66, and terminates in an annular base wall 68 having a sealing surface 70. An annular seal wall 72 depends axially away from the wall 60 via the internal wall 64 and base wall 68 in a direction generally toward the open end 58 of the closure 24 and terminates in an open end 74 of its own having a tapered external surface 76. The base wall 68 extends radially outwardly and forms a T shape with an outer wall or skirt 78. Thus, the skirt 78 is attached to and generally depends axially away from the wall 60 via the internal wall 64 and base wall 68. An upper end 80 of the skirt 78 depends axially away from the base wall 68 in a direction generally toward the wall 60 so as to define an annular channel 82 that cooperates with the open end 30 of the container 22 (shown in FIG. 7) in a non-child-resistant mode of operation. A lower end 84 of the skirt 78 also depends axially away from the base wall 68 in a direction generally toward the open end 58 so as to define another annular channel 86 that cooperates with the open end 30 of the container 22 (shown in FIG. 7) in a child-resistant mode of operation. The lower end 84 of the skirt 78 includes a plurality of locking lugs 88 that extend radially inwardly from a radially inward or internal surface 90 of the skirt 78 and that have a notch-engaging surface 92 thereon. Preferably, there are provided six such locking lugs 88, but more or fewer could be provided. The skirt 78 includes three cam lugs 94 extending radially inwardly therefrom and that define an internal diameter that is greater than that defined by the locking lugs 88. The cam lugs 94 include internal cam surfaces 96 thereon, which may be curved as shown or may be flat but angled surfaces, in which case it is preferred that the angles of the interengaging surfaces be about 12 to 15 degrees from vertical. In fact, the cam lugs 94 could be provided as a continuous or discontinuous annular bead. The cam lugs 94 are rigid extensions of the skirt 78 itself and are not themselves flexible, self-resilient members. Thus, only some portion(s) of the internal surface 90 of the skirt 78 need be provided with a cam surface or surfaces 96 that are complementary to the external cam surfaces 46 of the projections 34, and individual cam lugs 94 represent one way to do so.

Figure 2:
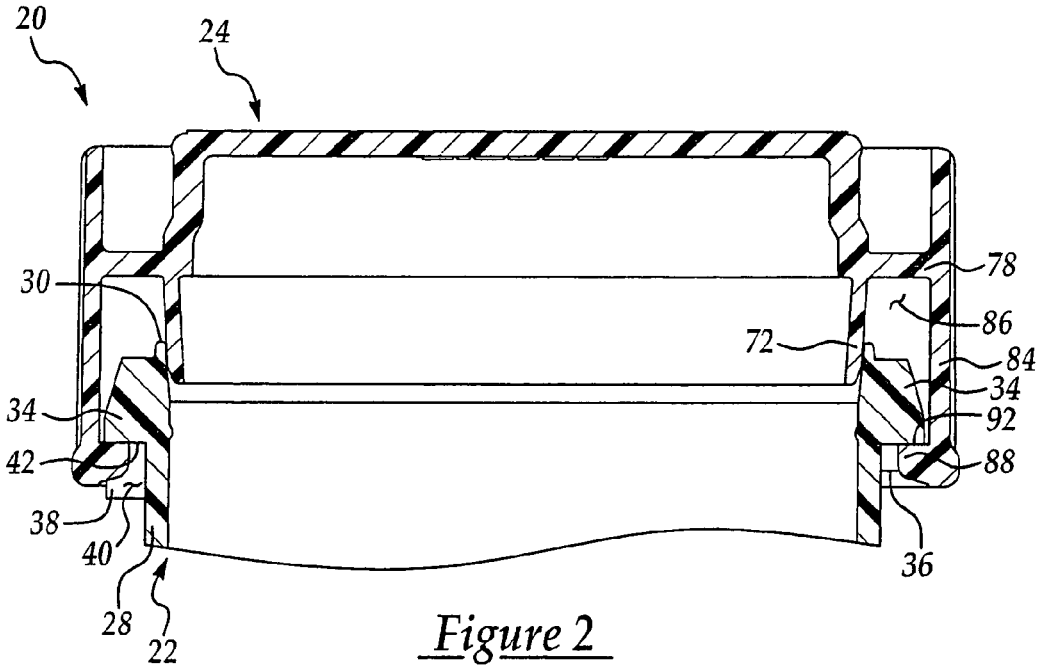
FIG. 2 is a fragmentary sectional view of the package illustrated in FIG. 1, taken along lines 2—2 through a locking lug of the closure.
Figure 3:
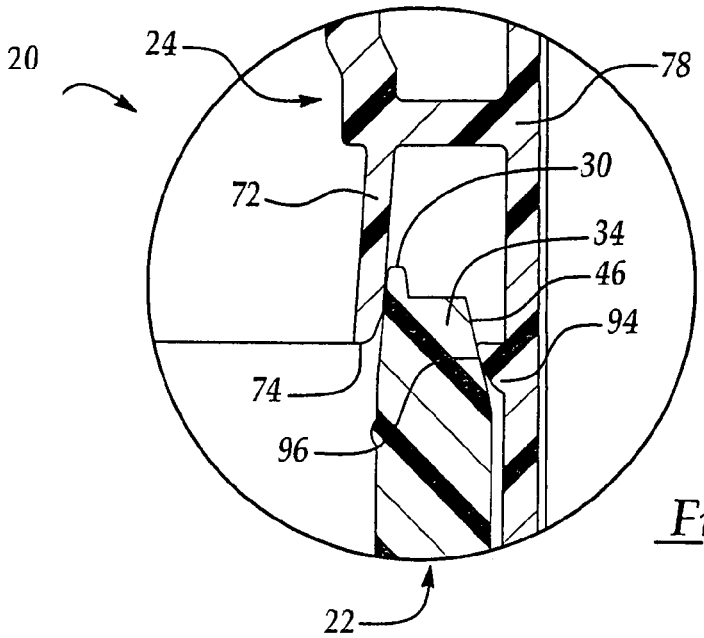
FIG. 3 is fragmentary sectional view of the package illustrated in FIG. 1 on an enlarged scale and taken through a cam lug of the closure.

In a child-resistant mode of operation illustrated in FIGS. 1–3, the lower end 84 of the skirt 78 of the closure 24 is received over the open end 30 of the side wall 28 of the container 22 such that the open end 30 extends into the annular channel 86 and the seal wall 72 extends into plug-sealing engagement within the open end 30 of the container 22 so as to create a moisture resistant seal. Clockwise rotation of the closure 24 on the container 22 cams the locking lugs 88 under the underside cam portions 36 of the projections 34 until the locking lugs 88 fall into trapped engagement within the notches 40 between the underside cam portions 36 and the stop lugs 38. Accordingly, the notch-engaging surfaces 92 of the locking lugs 88 are engaged against the flat undersides 42 of the projections 34. As best shown in FIG. 3, downward movement of the closure 24 onto the container 22 results in engagement of the internal cam surfaces 96 of the cam lugs 94 with the external cam surfaces 46 of the projections 34.

Continued downward movement of the closure 24 on the container 22 under a downward force causes the internal cam surfaces 96 to travel axially downwardly over the external cam surfaces 46, thereby causing the skirt 78 to flex, expand or spread radially outwardly. As the application force is released, a reaction force, due to the inherent resiliency of the cylindrical skirt, causes the skirt 78 to contract and permit the internal cam surfaces 96 to be urged axially upwardly along with the rest of the closure 24 including the locking lugs 88, which become urged into further engagement with the notches 40 of the container projections 34. Due to the rigidity of the projections 34 and cam lugs 94 and the relative flexibility of the skirt 78, the skirt 78 tends to resiliently stretch and deflect radially outwardly as downward pressure is applied to the closure 24 onto the container 22. As downward pressure is released, the resiliency or memory of the skirt 78 tends to cause the cam lugs 94 to ride back up the external cam surfaces 46 of the projections 34. Referring to FIGS. 1–3 in general, the resiliency of the skirt 78 and the interengagement of the cam surfaces 46, 96 thus cooperate to create an upward movement or upward bias of the closure 24 relative to the container 22, which tends to keep the locking lugs 88 firmly engaged within the notches 40 of the projections 34.

To remove the closure 24, downward pressure must be applied to the closure 24 relative to the container 22 to overcome the inherent resiliency of the skirt 78 and upward bias on the closure 24. Continued downward pressure displaces closure 24 and, thus, the locking lugs 88 in a downward direction such that the locking lugs 88 become disengaged from the notches 40. At this point it is possible to rotate the closure 24 in a counter-clockwise direction such that the locking lugs 88 clear the underside cam portion 36 so that the closure 24 can be removed in an upward direction off of the container 22.

In the non-child-resistant mode of operation illustrated in FIGS. 4–5, the closure 24 is inverted compared to FIGS. 1–3 and the wall 60 is inserted into the open end 30 of the container 22 until the annular projection 62 snaps past the inwardly projecting bead 54 of the container 22 to secure the closure 24 and the container 22 and until the open end 30 of the container 22 sealingly engages the sealing surface 70 of the base wall 68 of the closure 24. As best shown in FIG. 5, the stepped portion 66 of the closure 24 also preferably seals circumferentially with the tapered internal surface 56 of the container 22.

Figure 14:
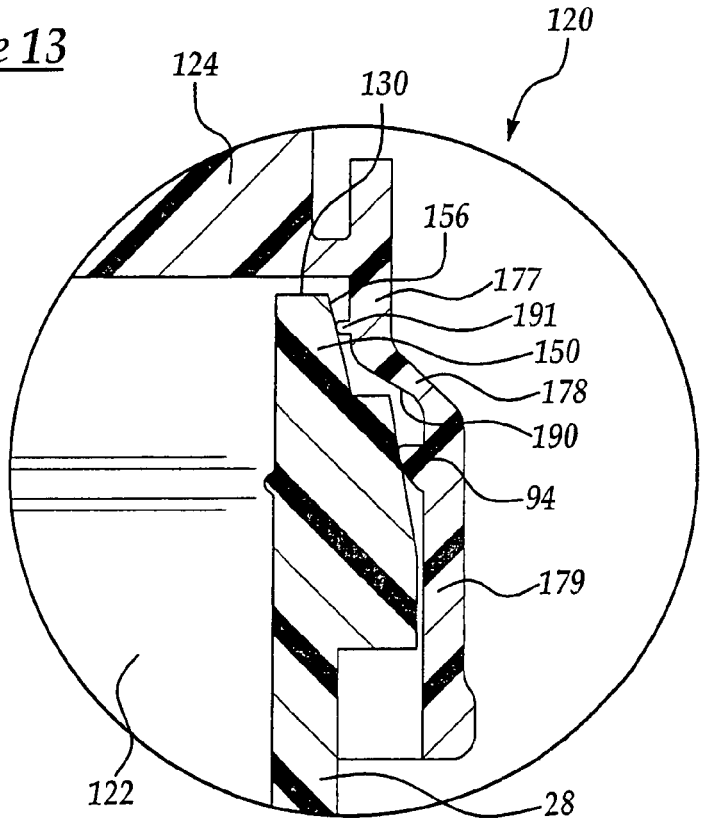
FIG. 14 is a fragmentary sectional view of a portion of a package according to another embodiment of the present invention having a different sealing arrangement than the embodiment of FIGS. 1–13.

FIG. 14 illustrates a package 120 in accord with a modified embodiment of the present invention, wherein the sealing configuration is modified. The package 120 includes a closure 124 mounted on a container 122 in a child-resistant mode of operation. The non-child-resistant mode of operation is identical to that described above. The container 122 is similar to the container 22 discussed in detail in connection with FIGS. 1–13, except that a stem portion 150 includes a conical or tapered external surface 156. Likewise, the closure 124 is nearly identical to the closure 24 discussed in connection with FIGS. 1–13, except that a skirt 178 is stepped to include a radially outer portion 179 disposed remotely of the base wall (not shown) of the closure 124 and a radially inner portion 177 adjacent to the base wall. The radially inner portion 177 includes a sealing bead 191 extending from an internal surface 190 thereof. Accordingly, the closure 124 of this embodiment seals in an exterior rather than interior fashion about the open end 130 of the container 122. The package 120 is otherwise the same as the embodiment discussed above in connection with FIGS. 1–13.

Directional words such as "upwardly" and "downwardly" are employed by description and not limitation with respect to the orientation of the package. Likewise, other directional words such as "axial" and "radial" are employed by description and not limitation with respect to the longitudinal axis of the package.

U.S. patent application Ser. No. 10/684,724 filed Oct. 13, 2003, is assigned to the assignee hereof and is incorporated by reference herein.

There have thus been described a closure and container package, a closure, a container, and a method of making a closure and container package that fully satisfy all of the objects and aims previously set forth. The present invention has been disclosed in conjunction with presently preferred embodiments thereof, and a number of modifications and variations have been discussed. Other modifications and variations will readily suggest themselves to persons of ordinary skill in the art in view of the foregoing description. Indeed, the invention is intended to embrace all modifications and variations as fall within the spirit and broad scope of the appended claims.

The invention claimed is:

1. A child-resistant package that includes:

a container having an open end surrounded by a cylindrical wall and a plurality of external projections on said wall, each of said projections having an undersurface with a notch and an external cam upper surface that inclines radially inwardly and axially toward said open end, and a closure that includes a base wall with a skirt, a first plurality of internal locking lugs on said skirt and a second plurality of internal cam lugs on said skirt disposed between said locking lugs and said base wall, said internal locking lugs being received in said notches, said internal cam lugs engaging said external cam upper surfaces on said projections resiliently to expand said skirt as said closure is applied to said container and thereby to develop a spring force that holds said locking lugs in said notches.

2. The package set forth in claim 1 wherein said external cam upper surfaces are disposed on said projections between said notches and said open end.

3. The package set forth in claim 1 wherein said external cam upper surfaces are disposed on a common cone of revolution.

4. The package set forth in claim 1 wherein said closure includes an annular wall for internal plug sealing engagement within said open end of said container.

5. The package set forth in claim 1 wherein said container has a conical external surface adjacent to said open end, and wherein said skirt is stepped, having a first radially internal portion adjacent to said base wall for resilient sealing engagement with said conical external surface and a second radially outer portion remote from said base wall on which said cam lugs and said locking lugs are disposed.

* * * * *